US012685365B2

(12) United States Patent
Giordani et al.

(10) Patent No.: US 12,685,365 B2
(45) Date of Patent: Jul. 21, 2026

(54) INSERT OR MIDSOLE FOR A FOOTWEAR

(71) Applicant: Tasci S.R.L., Rovereto (IT)

(72) Inventors: Roberto Giordani, Zanè VI (IT); Giorgio Franco, Zanè VI (IT)

(73) Assignee: Tasci S.R.L., Rovereto (IT)

( * ) Notice: Subject to any disclaimer, the term of this patent is extended or adjusted under 35 U.S.C. 154(b) by 60 days.

(21) Appl. No.: 18/572,815

(22) PCT Filed: Jun. 21, 2022

(86) PCT No.: PCT/IT2022/050175
§ 371 (c)(1),
(2) Date: Dec. 21, 2023

(87) PCT Pub. No.: WO2022/269646
PCT Pub. Date: Dec. 29, 2022

(65) Prior Publication Data

US 2024/0285025 A1 Aug. 29, 2024

(30) Foreign Application Priority Data

Jun. 25, 2021 (IT) ..... 102021000016769

(51) Int. Cl.
*A43B 13/12* (2006.01)
*A43B 13/28* (2006.01)

(52) U.S. Cl.
CPC ..... *A43B 13/125* (2013.01); *A43B 13/28* (2013.01)

(58) Field of Classification Search
CPC ..... A43B 13/125; A43B 13/28; A43B 13/145; A43B 13/181; A43B 13/186; A43B 13/04; A43B 13/146
See application file for complete search history.

(56) References Cited

U.S. PATENT DOCUMENTS

2011/0072684 A1* 3/2011 Stubblefield ..... A43B 13/122 36/28
2012/0144695 A1 6/2012 McDowell et al.
2015/0164178 A1* 6/2015 Lee ..... A43B 7/1464 36/114
2018/0140041 A1* 5/2018 Comstock ..... A43B 7/146
2018/0368516 A1* 12/2018 Mason ..... A43B 7/1475

FOREIGN PATENT DOCUMENTS

WO WO 2006/049401 5/2006
WO WO 2016/022354 2/2016
WO WO 2022/269646 12/2022

OTHER PUBLICATIONS

International Search Report and the Written Opinion Dated Jul. 20, 2022 From the International Searching Authority Re. Application No. PCT/IT2022/050175. (7 Pages).

* cited by examiner

*Primary Examiner* — Bao-Thieu L Nguyen

(57) ABSTRACT

A Footwear comprising a sole (12) and a midsole (10), which is placed in contact with the foot (15) of a user and which has a structure (14) made of elastomer. The midsole (10) has a series of zones or regions (11A, 11B, 11C) in correspondence with which a lower profile of the midsole (10) placed in contact with said sole (12) is emptied in correspondence with a series of spaces (13) of predetermined height made between said structure (14) and said sole (12).

14 Claims, 3 Drawing Sheets

SEC C-C'

*SEC A-A'*

*SEC B-B'*

*SEC C-C'*

*SEC D-D'*

*SEC E-E'*

*SEC F-F'*

*SEC G-G'*

*SEC H-H'*

*SEC. M-M'*

*SEC. N-N'*

*SEC. O-O'*

INSERT OR MIDSOLE FOR A FOOTWEAR

RELATED APPLICATIONS

This application is a National Phase of PCT Patent Application No. PCT/IT2022/050175 having International filing date of Jun. 21, 2022, which claims the benefit of priority of Italy Patent Application No. 102021000016769 filed on Jun. 25, 2021. The contents of the above applications are all incorporated by reference as if fully set forth herein in their entirety.

FIELD AND BACKGROUND OF THE INVENTION

The present invention generally relates to an insert or midsole shaped in a particular manner to be coupled preferably to a sole for footwear; the midsole may be inserted into any footwear or into similar articles which are themselves inserted into a footwear, such as an inner shoe of a ski boot.

The structural composition of the insert according to the invention allows for a cushioning function of the user's body weight and/or of shocks or impacts resulting in comfort of the foot whether standing for a long time or during walking or running.

The insert is made, in particular, of one or more thermoplastic elastomers having certain structures in the various parts of the foot.

The technical and geometric characteristics of the thermoplastic elastomer used make it possible to obtain the cushioning function and consequent comfort for the user, as the negative effect of the impact of the rounded parts of the bottom of the foot in contact with the ground and flat surfaces is significantly reduced, thus guaranteeing a high level of comfort for the foot both statically, when standing for many hours, and dynamically, when walking or running.

Various cushioning systems or systems for recycling air internally and pumping air externally are currently on the market.

With reference to the above-mentioned systems, all of them are made with specific details to realise a specific function, such as a sole designed for the purpose, the use of water-repellent membranes and/or various pumping elements, such as air chambers and/or plastic trays, in order to realise the cushioning and temperature regulation functions inside the footwear, through the recycling of internal air.

All these solutions impose expensive components, due to the need for dedicated equipment and/or complex and costly production processes.

Other shock-absorbing, elastic and anti-vibration materials that can be used for the construction of sports skates and/or footwear are also known.

SUMMARY OF THE INVENTION

The aim of the present invention is therefore to overcome the technical disadvantages complained of above and, in particular, to create an insert or midsole for footwear, which is able to significantly reduce the negative effect of the impact of the rounded parts of the bottom of the foot in contact with the ground and with flat surfaces, thus ensuring a high comfort of the user's foot both statically, standing for many hours, and dynamically, when walking or running.

Advantageously, in practice, the midsole is hollowed out or incised in predefined anatomically shaped areas in order to achieve a high level of comfort of the user's foot both in static conditions (user standing still for a certain period of time) and in dynamic conditions (user during walking or running).

The particular anatomical shape of the aforementioned incised areas copying the bottom of the user's foot, with their rounded protruding parts, determines the well-being and comfort of the foot in various situations.

In fact, an interface is created between the sole of the footwear and the protruding rounded parts, which partially collapse with the weight and movement of the user, cushioning his shocks.

BRIEF DESCRIPTION OF THE SEVERAL VIEWS OF THE DRAWINGS

Further features and advantages of the insert or midsole for footwear, according to the present invention, will be more apparent from the following description of an exemplifying and preferred, but not limiting, embodiment of the insert object of the invention, and from the accompanying drawings, wherein.

DESCRIPTION OF SPECIFIC EMBODIMENTS OF THE INVENTION

Figure 1:
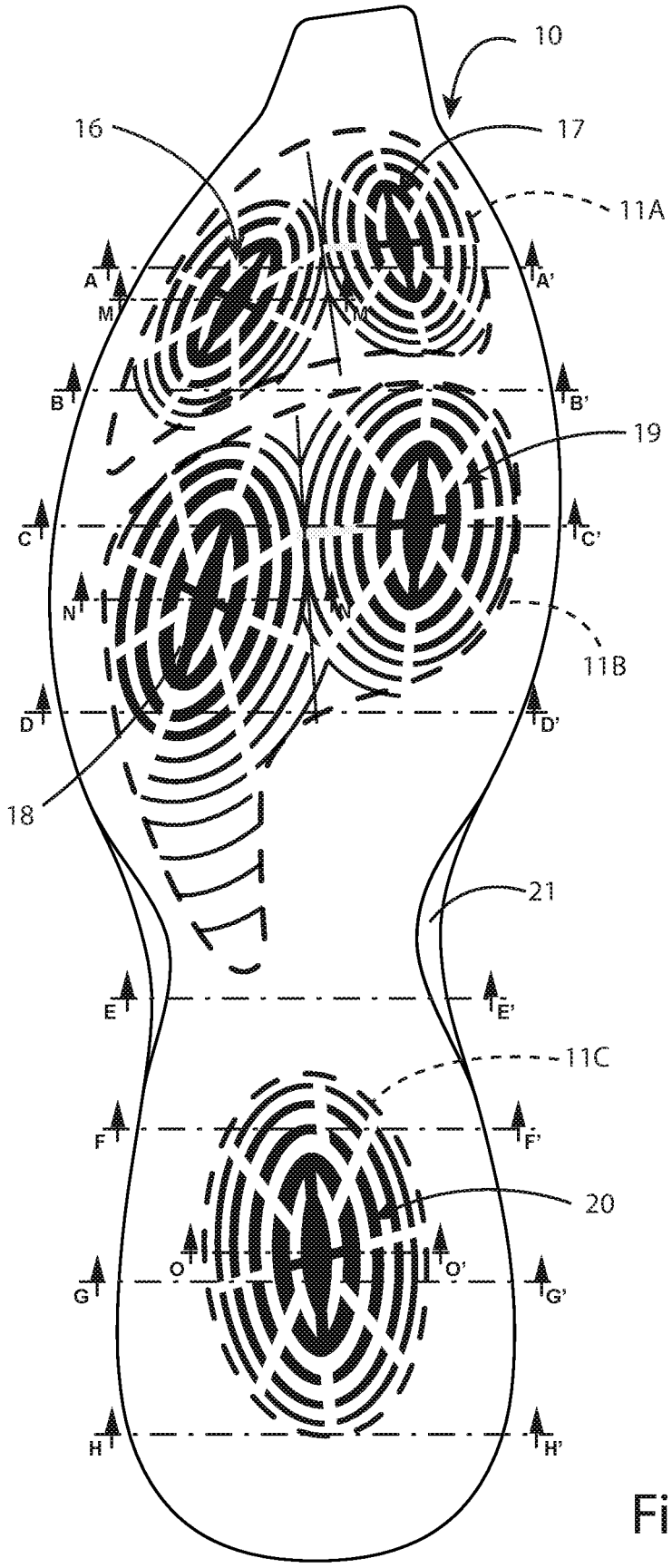
FIG. 1 shows a plan view of an insert or midsole made according to the present invention.

With reference to the above-mentioned figures, the insert or midsole according to the present invention is generically indicated by reference 10 and is interposed between a sole 12 and the foot 15 of the user, within a shoe.

The midsole 10, which has a structure 14 preferably made of elastomer and, in particular, of EVA, provides a series of zones or regions 11A, 11B, 11C wherein the lower profile of the midsole 10, placed in contact with the sole 12, is emptied so as to create a series of empty spaces 13 of predetermined height between the elastomer structure 14 of the midsole 10 and the sole 12.

Figure 3:
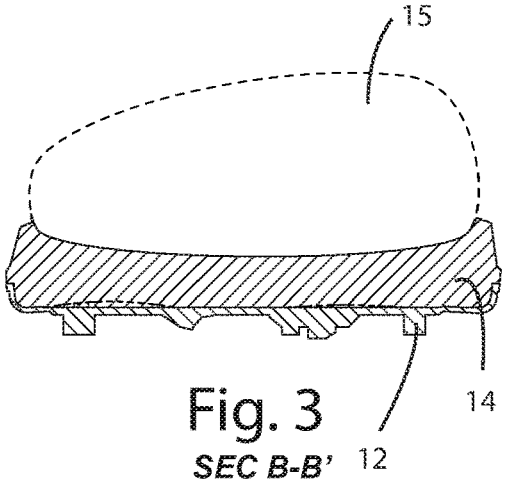
Figure 6:
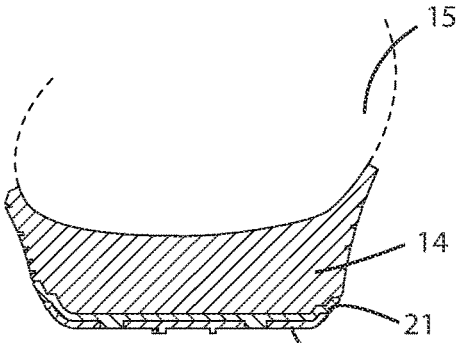
Figure 9:
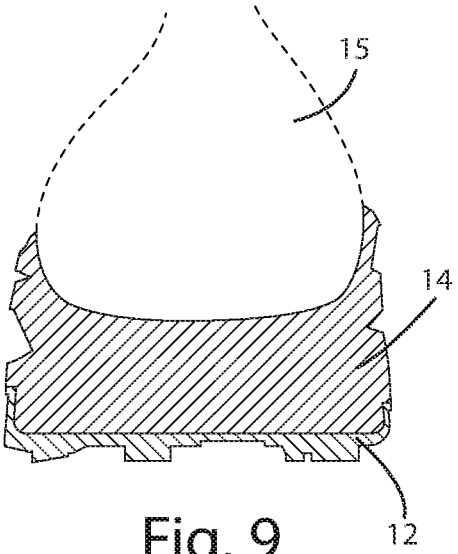

In particular, the zones 11A, 11B, 11C where the emptying of the midsole 10 is performed correspond to the anterior and median plantar fascia and to the region of the heel (FIG. 1, 2, 4, 5, 7, 8), while a plantar fascia located between the zones 11A and 11B (FIG. 3), a fascia substantially corresponding to the cambril 21 of the footwear (FIG. 6) and a posterior fascia to the region of the heel (FIG. 9) are substantially free.

Even more particularly, the emptying is carried out according to transversal directions to the midsole 10 obtaining empty spaces 13 with substantially rectangular geometry and increasing and decreasing heights between the longitudinal axis of the midsole 10 and the lateral ends of the zones 11A, 11B, 11C.

Figure 2:
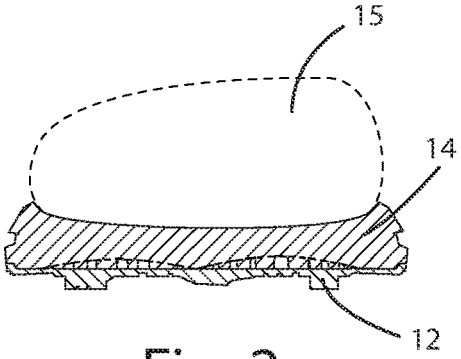
FIGS. 2 to 9 show respective sectional views of the insert, according to the invention, made along lines A-A', B-B' C-C', D-D', E-E', F-F', G-G' and H-H', with the insert inserted in a shoe worn by a user.

Advantageously, in correspondence with a first front zone 11A of the midsole 10, two portions 16, 17 are provided in which an emptying of the elastomer structure 14 facing the sole 12 is carried out by obtaining empty spaces 13, the height of which presents a curvilinear and asymmetrical trend on either side with respect to a longitudinal axis of the midsole 10 (FIG. 2).

Figure 4:
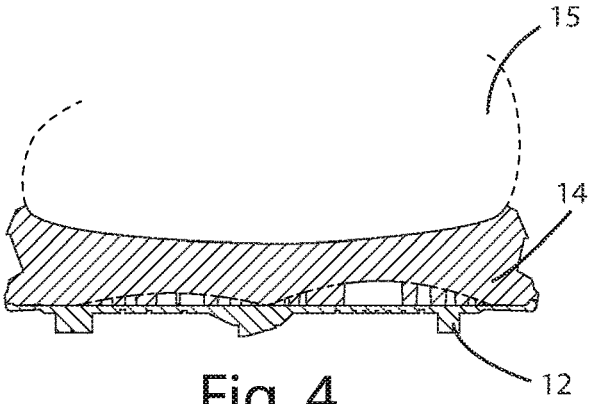
Figure 5:
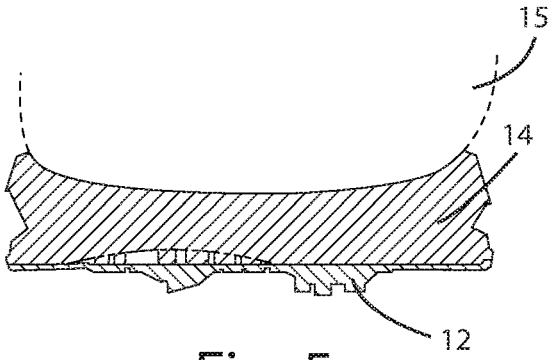

Similarly, in correspondence with a second median zone 11B of the midsole 10, two other portions 18, 19 are provided in which an emptying of the elastomer structure 14 facing the sole 12 is carried out, obtaining empty spaces 13, the height of which presents a curvilinear and asymmetrical course on either side with respect to a longitudinal axis of the midsole (FIG. 4, 5).

Figure 7:
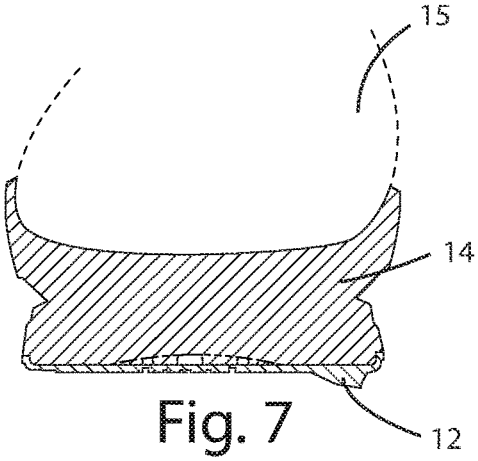
Figure 8:
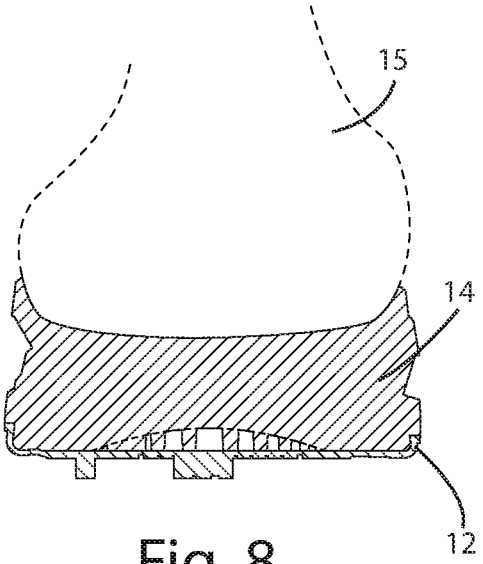

Finally, in correspondence with the heel of the foot 15 of the user, a portion 20 is provided in which an emptying of the elastomer structure 14 facing the sole 12 is carried out, obtaining empty spaces 13 whose height presents a curvilinear and symmetrical trend on either side with respect to the longitudinal axis of the midsole 10 (FIG. 7, 8).

Figure 10:
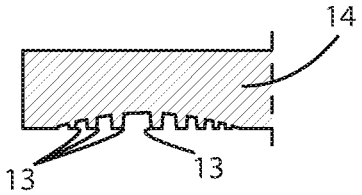
FIGS. 10 to 12 show respective sectional views of the insert, according to the invention, made along the lines M-M', N-N', O-O'.
Figure 11:
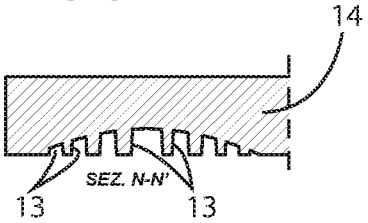
Figure 12:
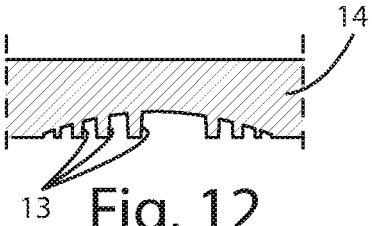

Furthermore, again advantageously, the height of the empty spaces 13 is greater at the portions 18, 19 and 20 than at the portions 16 and 17 (FIG. 10-12).

A midsole structure 10 thus realised enables advantageous cushioning of the rounded parts of the bottom of the foot 15 of the user in contact with the ground and with flat surfaces, generating a beneficial effect on the comfort of the user both statically, when standing for many hours, and dynamically, when walking or running.

The invention thus conceived and illustrated herein is susceptible to numerous modifications and variations, all within the scope of the inventive concept.

Furthermore, all details may be replaced by other technically equivalent elements.

Finally, the components used, provided they are compatible with the specific use, as well as the dimensions, may be any according to the requirements and state of the art.

Where the features and techniques mentioned in any claim are followed by reference marks, those reference marks have been included for the sole purpose of increasing the intelligibility of the claims and, accordingly, those reference marks have no limiting effect on the interpretation of each element identified by way of example by those reference marks.

The invention claimed is:

1. A footwear comprising:

a sole; and a midsole configured to be placed in contact with a foot of a user, said midsole having a structure made of elastomer, wherein said midsole has a series of zones or regions in correspondence with which a lower profile of the midsole placed in contact with said sole is emptied to form continuous recesses defining a series of spaces of predetermined height between said structure and said sole, wherein in correspondence with a first of said zones or regions—there are two first portions in correspondence with which said spaces are provided in said structure, and wherein said spaces—have a height with a curvilinear and asymmetrical course on one side and on the other with respect to a longitudinal axis of the midsole.

2. The footwear of claim 1, wherein said zones or regions correspond to an anterior and median plantar region and to a heel region of the foot of the user.

3. The footwear of claim 1, wherein said spaces have a substantially rectangular geometry and increasing and decreasing heights between a longitudinal axis of the midsole and lateral ends of said zones or regions.

4. The footwear of claim 1, further comprising, in correspondence with a second of said zones or regions, two second portions in correspondence with which said spaces are provided in said structure.

5. The footwear of claim 4, wherein said spaces have a height with a curvilinear and asymmetrical trend on one side and on the other with respect to a longitudinal axis of the midsole.

6. The footwear of claim 4, further comprising, in correspondence with a third of said zones or regions, a third portion in correspondence with which said spaces are provided in said structure, a height of said third portion having a curvilinear and symmetrical course on both sides with respect to said longitudinal axis of the midsole.

7. The footwear of claim 6, wherein said spaces have a height in correspondence with said second and third portions which is greater with respect to said first portions.

8. The footwear of claim 1, wherein said spaces are defined by said continuous recesses formed in said lower profile of the midsole rather than by individual discrete structural elements extending from said structure.

9. The footwear of claim 1, wherein said emptying of the lower profile creates said continuous recesses such that elastomer portions of said structure overlying said spaces are adapted to deform into said spaces under the weight of the user.

10. The footwear of claim 1, wherein said spaces extend continuously along a transverse direction of the midsole within each of said zones or regions.

11. The footwear of claim 4, wherein said zones or regions having said spaces are separated by intermediate regions substantially free of said spaces, said intermediate regions including a plantar fascia located between said first zone and said second zone, a fascia substantially corresponding to a cambril of the footwear, and a posterior fascia to a heel region.

12. The footwear of claim 1, wherein said emptying comprises removing material from a continuous surface of said lower profile to form said continuous recesses defining said spaces of predetermined height.

13. The footwear of claim 1, wherein said curvilinear and asymmetrical course is a smooth curvilinear and asymmetrical course.

14. The footwear of claim 13, wherein the curvilinear course of the height of said spaces defines a continuously-varying profile without angular or stepped transitions.

* * * * *